US007163458B2

(12) United States Patent
Schugar

(10) Patent No.: US 7,163,458 B2
(45) Date of Patent: Jan. 16, 2007

(54) CASINO GAME FOR BETTING ON BIDIRECTIONAL LINEAR PROGRESSION

(76) Inventor: David Schugar, 3471 Sundial Dr., Hernando, MS (US) 38632

( * ) Notice: Subject to any disclaimer, the term of this patent is extended or adjusted under 35 U.S.C. 154(b) by 233 days.

(21) Appl. No.: 10/688,898

(22) Filed: Oct. 21, 2003

(65) Prior Publication Data

US 2005/0085290 A1 Apr. 21, 2005

(51) Int. Cl.
*A63F 13/00* (2006.01)
*A63F 1/00* (2006.01)

(52) U.S. Cl. ..... 463/16; 273/138.1; 273/274; 273/243

(58) Field of Classification Search ..... 273/243, 273/274; 463/16
See application file for complete search history.

(56) References Cited

U.S. PATENT DOCUMENTS

| | | | | |
|---|---|---|---|---|
| 1,717,074 | A | 1/1876 | Walker | |
| 1,797,742 | A | 3/1931 | Ward | |
| D151,562 | S | 10/1948 | Southwell | |
| 2,664,292 | A | 12/1953 | Lee | |
| 2,739,815 | A | 3/1956 | Fay | |
| 3,560,127 | A | 2/1971 | Imperato | |
| 3,645,531 | A * | 2/1972 | Wright | 463/17 |
| 3,690,666 | A | 9/1972 | Seitz | |
| D226,111 | S | 1/1973 | Kehn | |
| 3,729,193 | A | 4/1973 | Labis | |
| 3,761,091 | A | 9/1973 | Zohn | |
| 3,883,143 | A | 5/1975 | Kelley et al. | |
| 3,963,243 | A | 6/1976 | Contento | |
| 4,042,245 | A | 8/1977 | Zarour | |
| 4,060,246 | A | 11/1977 | Ward | |
| 4,082,289 | A | 4/1978 | Merritt | |
| 4,119,321 | A | 10/1978 | Creel | |
| 4,199,147 | A | 4/1980 | Stansberry | |
| 4,211,419 | A | 7/1980 | Larsen | |
| 4,288,077 | A | 9/1981 | Rose | |
| 4,334,685 | A * | 6/1982 | Robbins et al. | 273/274 |
| 4,373,723 | A | 2/1983 | Brown et al. | |
| 4,428,580 | A | 1/1984 | Pasquine | |
| 4,527,798 | A | 7/1985 | Siekierski et al. | |
| 4,635,938 | A | 1/1987 | Gray | |
| 4,844,462 | A | 7/1989 | Lubniewski | |
| 4,874,177 | A | 10/1989 | Girardin | |
| 4,887,819 | A | 12/1989 | Walker | |
| 4,900,034 | A | 2/1990 | Bereuter | |

(Continued)

FOREIGN PATENT DOCUMENTS

GB 2133992 * 8/1984

OTHER PUBLICATIONS

Sink or Swim © 2003 Black Box Gaming.*

*Primary Examiner*—Mark Sager
*Assistant Examiner*—Robert Mosser
(74) *Attorney, Agent, or Firm*—Muskin & Cusick LLC

(57) ABSTRACT

A casino table or slot game whereby players bet on a moving piece on a table. The piece can move in two opposite directions on a line, the movement being determined by a random number generating device such as die or dice. The die will continuously be rolled, and the piece will be moved accordingly, until the piece reaches either end of each side of the line. Players bet on which end of the line the piece will reach first.

20 Claims, 6 Drawing Sheets

U.S. PATENT DOCUMENTS 4,917,386 A 4/1990 Tozer
5,050,888 A 9/1991 Schultz et al.
5,085,441 A 2/1992 Jova
5,092,605 A 3/1992 Hoffman
5,161,160 A 11/1992 Yaguchi et al.
5,186,460 A 2/1993 Fongeallaz et al.
5,226,655 A 7/1993 Rickabaugh
5,301,952 A 4/1994 Fitzgerald
5,367,286 A 11/1994 Voillat
5,383,669 A 1/1995 Vance
5,411,258 A 5/1995 Wilson et al.
5,564,701 A 10/1996 Dettor
5,607,159 A 3/1997 Bryson
5,696,481 A 12/1997 Pejas et al.
5,795,226 A 8/1998 Yi
5,823,872 A * 10/1998 Prather et al. ..... 463/6
5,839,726 A 11/1998 Luise
5,909,874 A 6/1999 Daniel
5,934,676 A 8/1999 Rubin
6,068,259 A 5/2000 Dolin
6,089,871 A 7/2000 Jaffe
6,210,275 B1 4/2001 Olsen
6,336,633 B1 1/2002 Webb
6,419,579 B1 7/2002 Bennett
6,464,225 B1 10/2002 Webb
6,520,502 B1 2/2003 Drouhard
6,520,855 B1 2/2003 DeMar
6,527,270 B1 3/2003 Maksymec et al.
6,896,264 B1 * 5/2005 Haber ..... 273/274
2002/0066998 A1 6/2002 Stern
2002/0145252 A1 10/2002 Michalek
2005/0082757 A1 * 4/2005 Cohen ..... 273/274

* cited by examiner

CASINO GAME FOR BETTING ON BIDIRECTIONAL LINEAR PROGRESSION

BACKGROUND OF THE INVENTION

1. Field of the Invention

The present invention is directed to a method, apparatus, and computer readable storage medium for a casino wagering game. More particularly, the present invention allows players to bet on a bidirectional linear progression.

2. Description of the Related Art

There is a wide variety of casino games. Both operators and players are always seeking games that are new and exciting.

SUMMARY OF THE INVENTION

It is an aspect of the present invention to provide improvements and innovations in casino games.

The above aspects can be obtained by a system that includes (a) displaying a linear playing field with a center and a first end and a second end; (b) receiving a wager that a piece will reach a desired end comprising either the first end or the second end; (c) moving the piece in either direction on the field in accordance with a random number generator; and (d) when the piece reaches either the first end or the second end, accounting for the wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
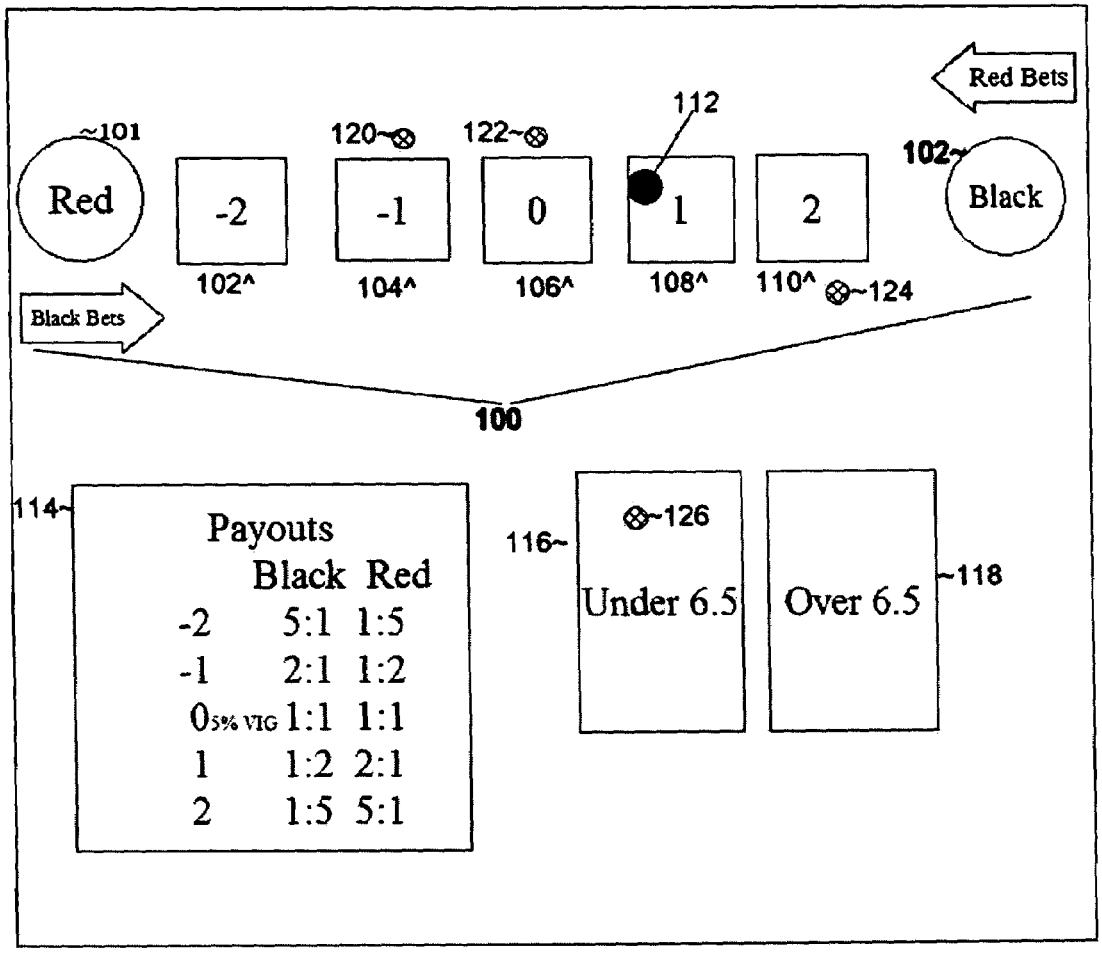
FIG. 1 is an illustration of a sample table layout, according to an embodiment of the present invention.

Reference will now be made in detail to the presently preferred embodiments of the invention, examples of which are illustrated in the accompanying drawings, wherein like reference numerals refer to like elements throughout.

The present invention relates to a casino table or slot game. More particularly, the present invention allows players to bet on a moving piece.

The game basically works as follows. The piece (or puck) can move in two opposite directions on a line (or playing field), the movement being determined by a random number generating device such as die, dice, number wheel, etc. For example, the die can have only two different values on it, +1 and −1 (a six sided die can have 3 sides of each). If the die lands on +1, then the piece will move ahead 1 unit. If the die lands on −1, then the piece will move behind 1 unit. The die will continuously be rolled, and the piece will be moved accordingly, until the piece reaches either end of each side of the line.

FIG. 1 is an illustration of a sample table layout, according to an embodiment of the present invention.

The playing field 100 comprises a red finish area 101 and a black finish area 102. The colors red and black are arbitrary and other descriptors can be used such as white/black, positive negative, heaven/hell, etc.

The playing field also comprises numbered squares. Pictured is a −2 square 102, a −1 square 104, a 0 square 106, a 1 square 108, and a 2 square 110. A puck 112 is pictured on the 1 square 108. While this example of the game illustrates 5 squares (−2, −1, 0, 1, 2), any number of squares can actually be used. The field can also be "off center" as well, for example (−2, −1, 0, +1), wherein when the puck starts on the center the puck has a better chance of making it to the right.

Players bet on which finish area (red finish area 101 or black finish area 102) the puck 112 will reach first. A random number generator (not pictured) is used to generate numbers that the puck will utilize. For example, a 6 sided die with 3 sides marked as "−1 " and 3 sides marked as "+1 " can be used. If the die lands on −1, then the puck 112 is moved to the left one square. If the dice lands on +1, then the puck 112 is moved to the right one square.

When the game starts, the puck 112 starts on the center (0 square 106). At the start, of course the chances of the puck 112 reaching either the red finish area 101 or the black finish area 102 is 50%. In order for the house to maintain an edge over the players, a commission can be collected, for example 5% of all winning bets.

A player can also place bets while the puck 112 is not at the center. For example, if the puck 112 is on the 2 square 110, the player might bet that the puck 112 will reach the black finish area 102 first. Of course, because the puck 112 is closer to the black finish area 102 than the red finish area 101, the payout on this bet would reflect these likely odds. On the other hand, if the player wishes to bet the puck 112 will reach the red finish area 101 first (while the puck is on the 2 square 110), then this outcome is much less likely, and the payout will reflect these more unlikely odds.

The location of bets (or chips) can be used to designate the exact type of bet made. For example, when the puck 112 is on the 0 square 106, a player wishes to bet that the puck 112 will reach the red finish area 101 first. Thus a red 0 bet 122 is placed above the 0 square 106. By placing a bet (or chip) above a particular square, this designates that the bet is betting to reach the red finish area first 101. By placing a bet (or chip) below a particular square, this designates that the bet is betting to reach the black finish area 102 first. The particular square the bet (or chip) is placed over or under designates the position of the puck 112 when the bet is made.

As another example, suppose the puck 112 is on the −1 square 104 and a player wishes to bet the puck 112 will reach the red finish area 101 first. A red −1 bet 120 is placed above the −1 square 104. As a further example, suppose the puck is on the 2 square 110 and the player wishes to bet that the puck 112 will reach the black finish area 102 first. A black 2 bet 124 is placed below the 2 square 110.

In this layout, players can place their own bets, or a dealer can place bets for players. As in craps, in this embodiment, players (and dealers) are responsible for keeping track of which bets belong to which players.

An optional payout chart 114 describes the payouts for all or some of the bets. In this particular example, when the puck 112 is on the −2 square 102, betting on black pays 5:1 and betting on red pays 1:5. When the puck 112 is on the −1 square 104, betting on black pays 2:1 and betting on red pays 1:2. When the puck 112 is on the 0 square 106, betting on black or red pays 1:1 (even money) but for a 5% commission to the house on winning bets. When the puck 112 is on the 1 square 108, betting on black pays 1:2 and betting on red pays 2:1. When the puck 114 is on the 2 square 110, betting on black pays 1:5 and betting on red pays 5:1.

Of course, the odds/payouts and house commission can be adjusted according to the casino's preferences.

Players can also make a variety of side bets. One such side bet is based on how many rolls from the start of a game (when the puck is on 0) it will take for the puck to reach either side.

An under box 116 and an over box 118 are pictured. In this example, the under/over amount is 6.5. Thus, by placing a bet in the over box 118, a player is betting that the puck will take more than 6.5 moves (each move is an amount indicated by the random number generator) to reach either finish area. For this side bet, it does not matter whether the puck 112 reaches the red finish area 101 or the black finish area 102. An under bet 126 is placed in the under box 116 which is betting that the puck 112 will have to be moved less than 6.5 times before reaching either end. The payouts for winning the under/over bet can bet chosen by the casino to suit their preferences (more on this will be discussed below). Of course, other amounts of moves can be used besides 6.5.

Figure 2:
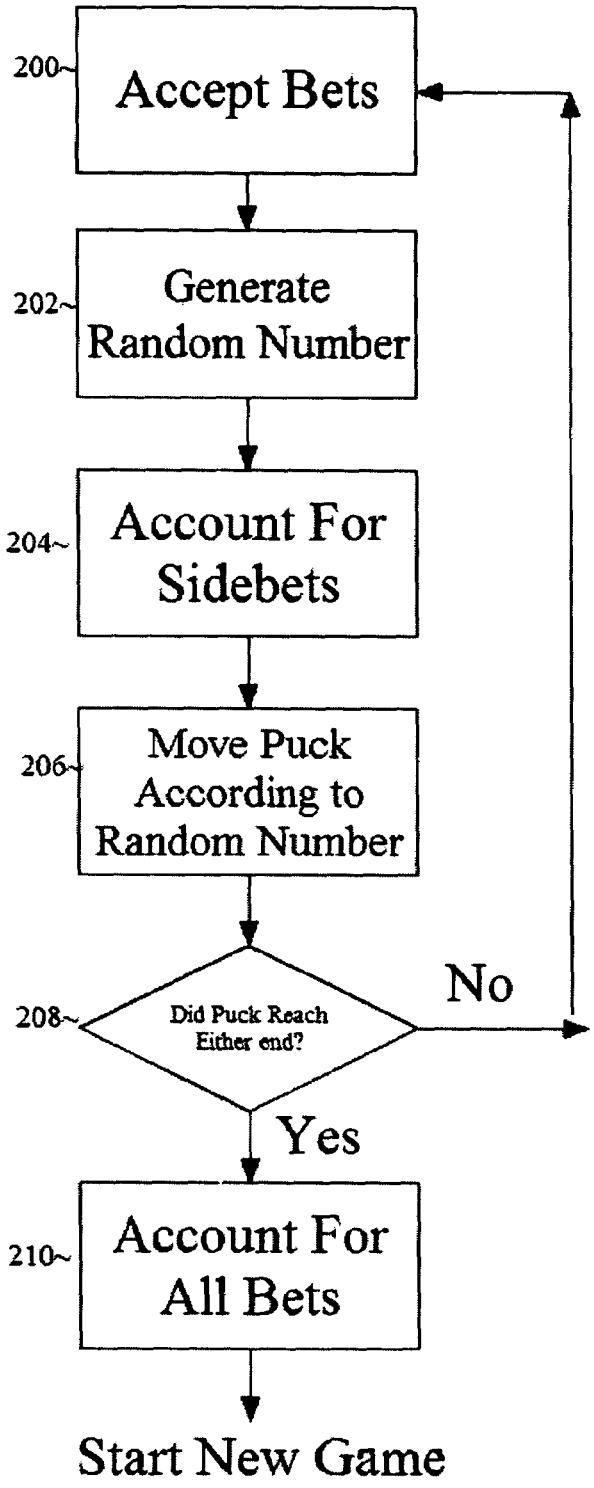
FIG. 2 is a flowchart illustrating a method utilized by the present invention, according to an embodiment of the present invention.

FIG. 2 is a flowchart illustrating a method utilized by the present invention, according to an embodiment of the present invention. It is noted that the present invention is not limited to this specific order, and this is just one example of an order and of operations used to implement the game described herein.

The method can start at operation 200 which accepts bets. If this is the very beginning of a game/round then the puck is placed at the center square. Bets can be accepted by players placing chips on a table in an appropriate place, and a dealer acknowledging and possibly handling the bet as well. Bets can also be placed by a player by placing a chip down and orally telling a dealer a desired bet.

From operation 200, the method proceeds to operation 202 which generates a random number. This can be done by rolling a die or dice, spinning a wheel, using an electronic random number generator, etc.

From operation 202, the method proceeds to operation 204 which accounts for side bets. Side bets (such as the under/over bet) can be resolved regardless of whether the puck reaches either finish area. Other side bets will be discussed below.

From operation 204, the method proceeds to operation 206, which moves the puck according to the random number generated in operation 202.

From operation 206, the method proceeds to check in operation 208 whether the puck has reached either finish end. If the puck has not reached either finish end, then the method returns to operation 200 which accepts more bets and continues the current game/round.

If the check in operation 208 results that the puck has reached either finish end, then the method proceeds to operation 210 which accounts for all bets. All winning bets are paid and all losing bets are taken. Then, a new game can be started by moving the puck to the center square and returning to operation 200.

As discussed above, the layout illustrated in FIG. 1 was a type of "undefined layout." In other words, it is the responsibility of the players and dealers to keep track of which bet belongs to which player. A more organized approach to keeping track of bets can also be used.

A more defined system can be used (similar to blackjack) where players sit down and each player has their own betting area in front of him or her. The betting area can resemble a miniature field like that pictured in FIG. 1, but without of course need for additional pucks. For example the betting area can comprise a table of red/black columns with rows for each of the numbered squares. A player can place a bet on red/black by placing chips in the appropriate column and using the corresponding row of where the puck currently is. The dealer can pay bets accordingly. The problem with this method is that by letting players handle their own bets, some players may be prone to cheating by manipulating their chips when the dealer is not watching.

Therefore, a more organized approach can be utilized to track individual bets with players having a reduced ability to cheat.

Figure 3:
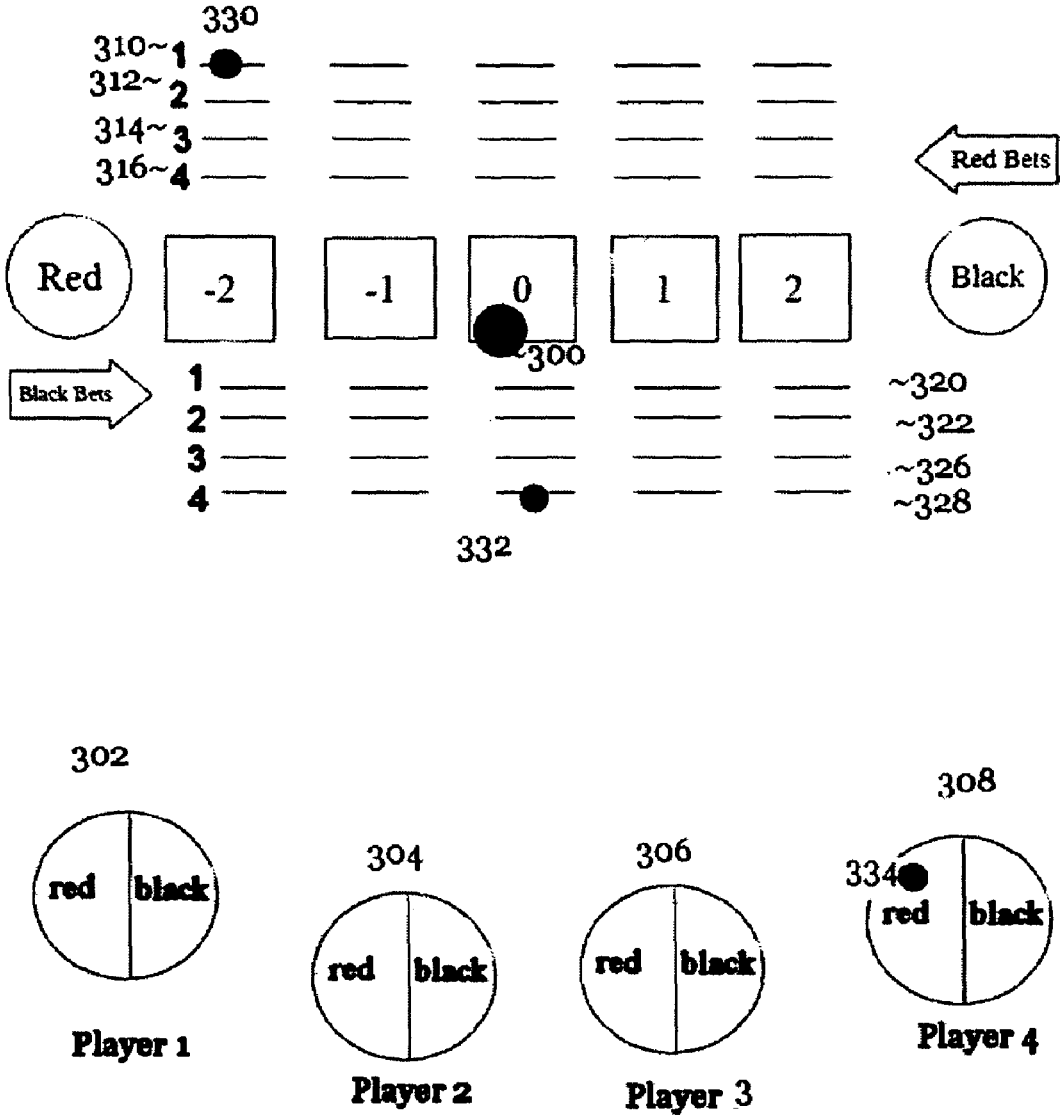
FIG. 3 illustrates an organized table layout, according to an embodiment of the present invention.

FIG. 3 illustrates an organized table layout, according to an embodiment of the present invention.

FIG. 3 illustrates a table layout accommodating four players (although of course many more players can be accommodated similarly). A puck 300 is in the center of the playing field.

A player 1 betting circle 302, a player 2 betting circle 304, a player 3 betting circle 306, and a player 4 betting circle 308, are used to take bets from player 1, player 2, player 3, and player 4, respectively. The betting circles are divided into a red half and a black half.

This embodiment uses numbered betting lines to keep track of bets for each player. Pictured are 8 betting lines for each of the 4 players: red line 1 310, red line 2, 312, red line 3 314, red line 4 316, black line 1 320, black line 2 322, black line 3, 326, and black line 4 328.

A player places a bet in his or her respective betting circle on either red or black. The dealer then takes the player's bet, and depending where the puck currently is, places the bet in an appropriate place on a respective betting line. If the player bets on red, then the respective red line is used. If a player bets on black, then the respective black line is used. The bet is placed by the dealer on the respective line in a position corresponding to where the puck currently is.

For example, suppose the puck is on the center square (it does not matter if this is the very beginning of the game or not). Player 4 wishes to bet on black. Thus, player 4 places his chip(s) in a black portion of the player 4 betting circle 308. The dealer will then move the player's chip(s) from the player 4 betting circle onto the black line 4 328. The dealer will place the chip(s) in a location aligned with where the 0 square is (since this is where the puck currently is). Thus, the dealer will move the player's chips to a line 4 black 0 bet 332.

As another example, a line 1 red −2 bet 330 is on the table. This bet represents a bet by player 1, while the puck is on the −2 square, that the puck will finish on the red side first.

Also pictured is a player 3 red bet 334, which will be moved by the dealer and labeled as a "line 3 red 0 bet." The number 0 is used because the puck is currently on the 0 square.

In the manner described above, a well organized table can be maintained, while a dealer(s) can easily see which player has what bets pending.

Not pictured in FIG. 3 are betting mechanisms (such as betting circles) for side bets, although these can also be added to the pictured layout.

All kinds of side bets can be offered. In addition to the under/over side bet described above, many other side bets can be offered as well.

For example, a side bet can be offered on what the next roll of the random number generator will be.

There are an almost infinite number of variations of the game. For example, a playing field with any number of squares can be used. Also, a random number generator that generates random numbers other than −1, +1 can be used. For example, the random number generator can also generate numbers such as −2, −1, +1, and +2. What follows is a mathematical analysis of selected variations/versions of the game. Version 1 is the preferred embodiment of the table game, while version 2 is the preferred embodiment of an electronic form of the game. In the following description, "left" and "right" is used in place of the red/black finishing areas described above.

Figure 4:
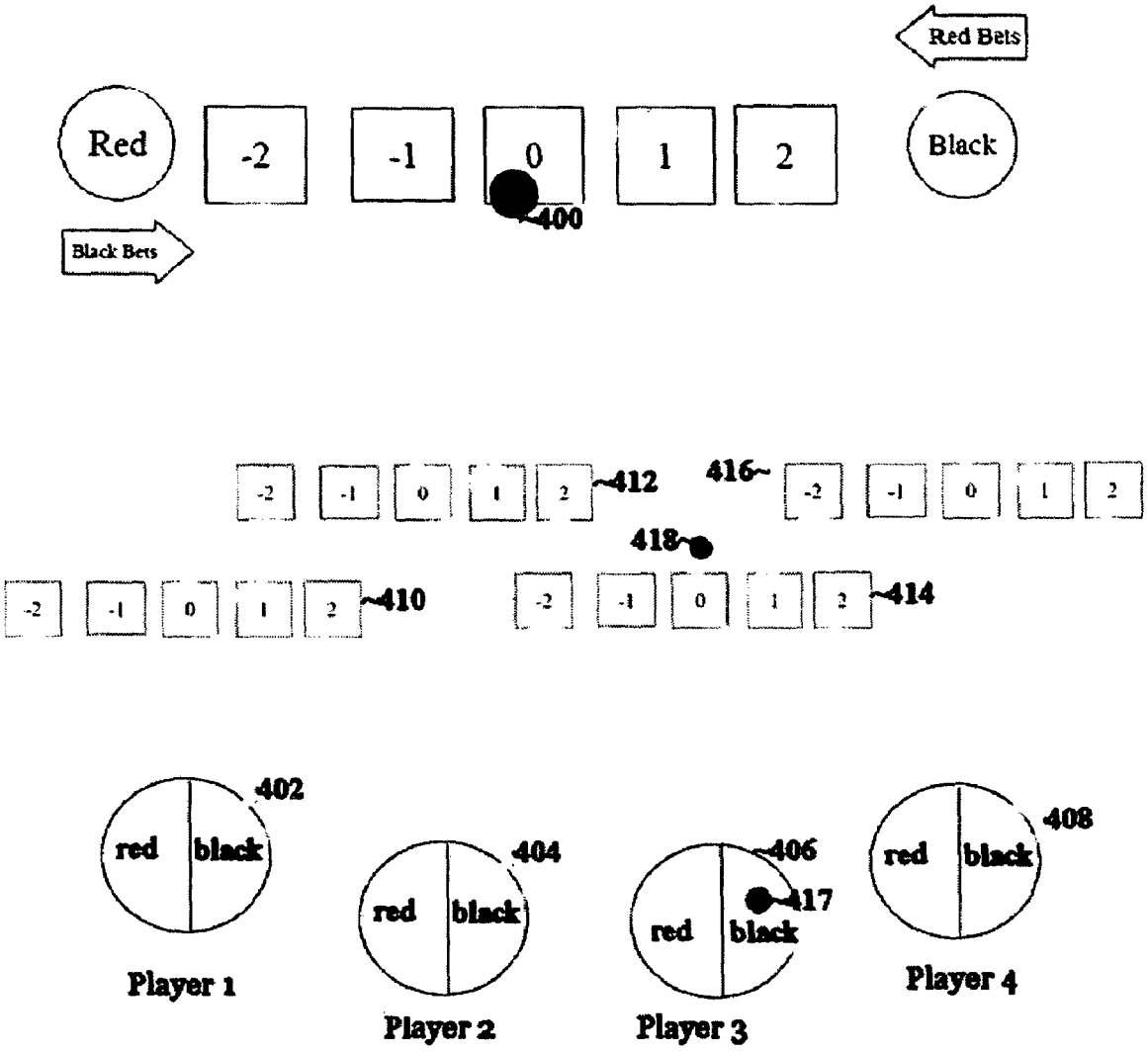
FIG. 4 illustrates a second table layout, according to an embodiment of the present invention.

FIG. 4 illustrates a second table layout, according to an embodiment of the present invention.

A puck 400 is in the middle ("0") position. Betting circles 402, 404, 406, 408, are for player 1, player 2, player 3, and player 4, respectively. Mini lines 410, 412, 414, 416, are for player 1, player 2, player 3, and player 4, respectively. The mini lines 410, 412, 414, 416, are used to track each player's bets, and serve the purpose of the betting lines from FIG. 3. In this embodiment, the dealer handles chips/bets and places them in the appropriate mini line so everyone (the players and dealer) can track which player has bets on what. The player typically places his or her bet in his or her betting circle, as described in FIG. 3, and the dealer moves the bet to the appropriate position in the respective mini line. This is done so that a player is not able to handle his own bets on the mini line, which could be conducive to cheating by the players. Each mini line tracks each player's bets in the manner as described regarding the large field in FIG. 3.

In an alternative to the above embodiment, betting circles are not used and each player can directly access and manipulate bets on his or her respective mini lines. However, this may be conducive to player cheating.

Table I shows parameters for six variations of the game. The parameters include the number of positions and probability of the die (random number generator) movement. All probabilities are divisible by 6, allowing for the roll of a die to determine the movement. Which side of the die determines which movement has yet to be determined, and is not mathematically relevant.

TABLE I

| Version | Positions on Number Line | Probability left 3 | Probability left 2 | Probability left 1 | Probability Right 1 | Probability Right 2 | Probability Right 3 |
|---|---|---|---|---|---|---|---|
| 1 | 3 | 0.00% | 0.00% | 50.00% | 50.00% | 0.00% | 0.00% |
| 2 | 5 | 0.00% | 0.00% | 50.00% | 50.00% | 0.00% | 0.00% |
| 3 | 5 | 0.00% | 16.67% | 33.33% | 33.33% | 16.67% | 0.00% |
| 4 | 7 | 0.00% | 16.67% | 33.33% | 33.33% | 16.67% | 0.00% |
| 5 | 7 | 16.67% | 16.67% | 16.67% | 16.67% | 16.67% | 16.67% |
| 6 | 9 | 16.67% | 16.67% | 16.67% | 16.67% | 16.67% | 16.67% |

Table II shows the pay table for bets that right will win for version 1. For odds that left will win simply multiply the position by −1.

TABLE II

| Position | Pays | Commission |
|---|---|---|
| −1 | 3 to 1 | 5% |
| 0 | 1 to 1 | 5% |
| 1 | 1 to 3 | 5% |

Table III shows the pay table for bets that right will win for version 2. For odds that left will win simply multiply the position by −1.

TABLE III

| Position | Pays | Commission |
|---|---|---|
| −2 | 5 to 1 | 5.00% |
| −1 | 2 to 1 | 5.00% |
| 0 | 1 to 1 | 5.00% |
| 1 | 1 to 2 | 5.00% |
| 2 | 1 to 5 | 5.00% |

Table IV shows the pay table for bets that right will win for version 3. For odds that left will win simply multiply the position by −1.

TABLE IV

| Position | Pays | Commission |
|---|---|---|
| −2 | 4 to 1 | 0.00% |
| −1 | 9 to 5 | 0.00% |
| 0 | 1 to 1 | 5.00% |
| 1 | 1 to 2 | 0.00% |
| 2 | 1 to 5 | 0.00% |

Table V shows the pay table for bets that right will win for version 4. For odds that left will win simply multiply the position by −1.

TABLE V

| Position | Pays | Commission |
|---|---|---|
| −3 | 11 to 2 | 0.00% |
| −2 | 11 to 4 | 0.00% |
| −1 | 3 to 2 | 0.00% |
| 0 | 1 to 1 | 5.00% |
| 1 | 3 to 5 | 0.00% |
| 2 | 1 to 3 | 0.00% |
| 3 | 1 to 7 | 0.00% |

Table VI shows the pay table for bets that right will win for version 5. For odds that left will win simply multiply the position by −1.

TABLE VI

| Position | Pays | Commission |
|---|---|---|
| −3 | 4 to 1 | 0.00% |
| −2 | 5 to 2 | 0.00% |
| −1 | 3 to 2 | 0.00% |
| 0 | 1 to 1 | 5.00% |
| 1 | 3 to 5 | 0.00% |
| 2 | 1 to 3 | 0.00% |
| 3 | 1 to 5 | 0.00% |

Table VII shows the pay table for bets that right will win for version 6. For odds that left will win simply multiply the position by −1.

TABLE VII

| Position | Pays | Commission |
|---|---|---|
| −4 | 5 to 1 | 0.00% |
| −3 | 3 to 1 | 0.00% |
| −2 | 2 to 1 | 0.00% |
| −1 | 4 to 3 | 0.00% |
| 0 | 1 to 1 | 5.00% |
| 1 | 2 to 3 | 0.00% |
| 2 | 2 to 5 | 0.00% |
| 3 | 1 to 4 | 0.00% |
| 4 | 1 to 6 | 0.00% |

Table VIII shows the over/under line for all versions of Tug of War, what the under bets pay, and the commission (if any).

TABLE VIII

| Version | Line | Under Pays | Commission |
|---|---|---|---|
| 1 | 3.5 | 1 to 1 | 5% |
| 2 | 6.5 | 6 to 5 | 0% |
| 3 | 3.5 | 5 to 4 | 0% |
| 4 | 6.5 | 1 to 1 | 0% |
| 5 | 3.5 | 1 to 1 | 0% |
| 6 | 4.5 | 6 to 5 | 0% |

Table IX shows the over/under line for all versions of Tug of War, what the over bet pays, and the commission (if any).

TABLE IX

| Version | Line | Over Pays | Commission |
|---|---|---|---|
| 1 | 3.5 | 1 to 1 | 5% |
| 2 | 6.5 | 7 to 10 | 0% |
| 3 | 3.5 | 2 to 3 | 0% |
| 4 | 6.5 | 5 to 6 | 0% |
| 5 | 3.5 | 5 to 6 | 0% |
| 6 | 4.5 | 7 to 10 | 0% |

Table X shows the payoff, commission, probability of winning, and house edge for all positions in version 1 that right will win. For odds that left will win simply multiply the position by −1.

TABLE X

| Position | Pays | Commission | Prob. Win | House Edge |
|---|---|---|---|---|
| −1 | 3.000000 | 0.050000 | 0.250000 | 0.050000 |
| 0 | 1.000000 | 0.050000 | 0.500000 | 0.050000 |
| 1 | 0.333333 | 0.050000 | 0.750000 | 0.050000 |

Table XI shows the payoff, commission, probability of winning, and house edge for all positions in version 2 that right will win. For odds that left will win simply multiply the position by −1.

TABLE XI

| Position | Pays | Commission | Prob. Win | House Edge |
|---|---|---|---|---|
| −2 | 5.000000 | 0.050000 | 0.166667 | 0.050000 |
| −1 | 2.000000 | 0.050000 | 0.333333 | 0.050000 |
| 0 | 1.000000 | 0.050000 | 0.500000 | 0.050000 |
| 1 | 0.500000 | 0.050000 | 0.666667 | 0.050000 |
| 2 | 0.200000 | 0.050000 | 0.833333 | 0.050000 |

Table XII shows the payoff, commission, probability of winning, and house edge for all positions in version 3 that right will win. For odds that left will win simply multiply the position by −1.

TABLE XII

| Position | Pays | Commission | Prob. Win | House Edge |
|---|---|---|---|---|
| −2 | 4.000000 | 0.000000 | 0.197368 | 0.013158 |
| −1 | 1.800000 | 0.000000 | 0.342105 | 0.042105 |
| 0 | 1.000000 | 0.050000 | 0.500000 | 0.050000 |
| 1 | 0.500000 | 0.000000 | 0.657895 | 0.013158 |
| 2 | 0.200000 | 0.000000 | 0.802632 | 0.036842 |

Table XIII shows the payoff, commission, probability of winning, and house edge for all positions in version 4 that right will win. For odds that left will win simply multiply the position by −1.

TABLE XIII

| Position | Pays | Commission | Prob. Win | House Edge |
|---|---|---|---|---|
| −3 | 5.500000 | 0.000000 | 0.150538 | 0.021505 |
| −2 | 2.750000 | 0.000000 | 0.260753 | 0.022177 |
| −1 | 1.500000 | 0.000000 | 0.381720 | 0.045699 |
| 0 | 1.000000 | 0.050000 | 0.500000 | 0.050000 |
| 1 | 0.600000 | 0.000000 | 0.618280 | 0.010753 |
| 2 | 0.333333 | 0.000000 | 0.739247 | 0.014337 |
| 3 | 0.142857 | 0.000000 | 0.849462 | 0.029186 |

Table XIV shows the payoff, commission, probability of winning, and house edge for all positions in version 5 that right will win. For odds that left will win simply multiply the position by −1.

TABLE XIV

| Position | Pays | Commission | Prob. Win | House Edge |
|---|---|---|---|---|
| −3 | 4.000000 | 0.000000 | 0.194561 | 0.027197 |
| −2 | 2.500000 | 0.000000 | 0.282427 | 0.011506 |
| −1 | 1.500000 | 0.000000 | 0.384937 | 0.037657 |
| 0 | 1.000000 | 0.050000 | 0.500000 | 0.050000 |
| 1 | 0.600000 | 0.000000 | 0.615063 | 0.015900 |
| 2 | 0.333333 | 0.000000 | 0.717573 | 0.043236 |
| 3 | 0.200000 | 0.000000 | 0.805439 | 0.033473 |

Table XV shows the payoff, commission, probability of winning, and house edge for all positions in version 6 that right will win. For odds that left will win simply multiply the position by −1.

TABLE XV

| Position | Pays | Commission | Prob. Win | House Edge |
|---|---|---|---|---|
| −4 | 5.000000 | 0.000000 | 0.159938 | 0.040373 |
| −3 | 3.000000 | 0.000000 | 0.231366 | 0.074534 |
| −2 | 2.000000 | 0.000000 | 0.315217 | 0.054348 |
| −1 | 1.333333 | 0.000000 | 0.413043 | 0.036232 |
| 0 | 1.000000 | 0.050000 | 0.500000 | 0.050000 |
| 1 | 0.666667 | 0.000000 | 0.586957 | 0.021739 |
| 2 | 0.400000 | 0.000000 | 0.684783 | 0.041304 |
| 3 | 0.250000 | 0.000000 | 0.768634 | 0.039208 |
| 4 | 0.166667 | 0.000000 | 0.840062 | 0.019928 |

Table XVI shows the payoff, commission, probability of winning, and house edge for under bet in all versions

TABLE XVI

| Version | Line | Pays | Commission | Prob. Win | House Edge |
|---|---|---|---|---|---|
| 1 | 3.5 | 1.000000 | 0.050000 | 0.500000 | 0.050000 |
| 2 | 6.5 | 1.200000 | 0.000000 | 0.437500 | 0.037500 |
| 3 | 3.5 | 1.250000 | 0.000000 | 0.425926 | 0.041666 |
| 4 | 6.5 | 1.000000 | 0.000000 | 0.476680 | 0.046640 |
| 5 | 3.5 | 1.000000 | 0.000000 | 0.481481 | 0.037038 |
| 6 | 4.5 | 1.200000 | 0.000000 | 0.435185 | 0.042593 |

Table XVII shows the payoff, commission, probability of winning, and house edge for the over bet in all versions

TABLE XVII

| Version | Line | Pays | Commission | Prob. Win | House Edge |
|---|---|---|---|---|---|
| 1 | 3.5 | 1.000000 | 0.050000 | 0.500000 | 0.050000 |
| 2 | 6.5 | 0.700000 | 0.000000 | 0.562500 | 0.043750 |
| 3 | 3.5 | 0.666667 | 0.000000 | 0.574074 | 0.043210 |
| 4 | 6.5 | 0.833333 | 0.000000 | 0.523320 | 0.040580 |
| 5 | 3.5 | 0.833333 | 0.000000 | 0.518519 | 0.049382 |
| 6 | 4.5 | 0.700000 | 0.000000 | 0.564815 | 0.039814 |

The above results can be determined by computer simulation. For example, a computer can be programmed to implement a large number of games with given parameters. The results of each game can be stored and tabulated, resulting in probabilities of a win for each position of the piece, and also probabilities of winning side bets such as the over/under. Matrix algebra can also be used to analyze the various variations of the game.

Once a probability of a particular wager has been determined, either the true probability can be paid to a player with a house commission deducted, or a straight payout can be set with a reduced payout than the true odds. Of course, a casino is free to choose payouts and methods they deem appropriate. The payouts listed in FIG. 1 are the preferred payouts for version 2 of the game (5 squares and a −1, +1 die).

The following formula can also be used to determine the probability of a piece reaching the right end, depending on the position of the piece (this formula assumes a −1, +1 die):

$p=S*(1/(X+1))$, where $X$ is the number of squares being used, and $S$ is the current square the piece is at.

For example, a game with 5 squares (−2, −1, 0, 1, 2), and the puck is in the center square (for purposes of the formula this is square #3). Thus, the probability of the puck reaching the right end is 3*(1/(5+1))=½. As another example, if the puck is on square 2, then p=5*(1/(5+1))=⅚. Both of these results conform to the results indicated in Table XI. To get the probability for going to the left end, simply take (1−p).

The present invention can also be implemented on an electronic gaming device (EGD) as well. Other examples of EGDs are slot machines, video poker machines, etc.

The EGD implementation of the present invention can play the same as the table embodiments described above. The EGD electronically handles all of the transactions above including taking and paying bets, according to well known principles in the EGD arts. The EGD implementations may also include additional variations not present in the table variations.

For example, a bonus round or jackpot can be initiated when a certain triggering condition has been met. For example, from the start of a game, if the puck has moved greater than a predetermined number of times without a resolution of the game, the player can be entitled to a jackpot or special bonus round. In this manner, players can enjoy the thrill of knowing they have the potential to win big without having to bet large amounts.

As another option, a "fast forward" button can be offered to the player. This automatically advances the current game to a resolution in an expeditious manner. For example, suppose the player bets at the start of a game that the puck will reach the red side first. The player decides he does not with to make any further bets and wishes the game to end quickly. The player can then just push a fast forward button, and the EGD will automatically and quickly continuously progress the game until a resolution is reached.

As a further option, the player can begin a game with the puck at any position the player wishes. For example, suppose the player wishes to place the puck at a particular position at the beginning of the game or at a time when there are no bets on the field. In these circumstances, the player has the option of placing the puck wherever he or she wishes.

In a further embodiment of the present invention, the electronic gaming device can automatically alert players to betting opportunities. A betting opportunity can comprise a situation where a player can hedge his or her bet to guarantee a winner.

For example, consider a game with a playing field of: −2, −1, 0, +1, +2. When the piece is on −2, the player bets $100 that the piece will finish on the right side of the line. Suppose the piece manages to make its way to +2. If the player now places a $100 bet that the piece will finish on the left side of the line, the player can guarantee himself a winner. This is because if the piece ends up finishing on the right side, the first bet wins $500 (although the second bet loses). If the piece ends up finishing on the left side, the second bet wins $500 (although the first bet loses). Thus, the player is guaranteed to win $400 employing this strategy.

The electronic gaming device can automatically detect such hedging situations by determining which of the player's bets have positive expectations and offering complimentary bets to cover them. An automatic pop up screen can appear with a message such as, "BETTING OPPORTUNITY ALERT!—A $100 BET ON LEFT WILL GUARANTEE YOU A WIN OF $400." In this manner, a player will be encouraged to bet more action. Alternatively, a "partial hedging situation" can also be automatically presented to the player. A partial hedging situation is where a player can hedge his or her but not to guarantee a win but make a win more likely, such as greater than 75%. Such a partial hedging situation notification could be as follows, "BETTING OPPORTUNITY ALERT!—A $50 BET ON RIGHT WILL GIVE YOU A 75% OR GREATER CHANCE OF WINNING OVERALL." The EGD can determine a partial hedging opportunity by automatically trying variations of bets and computing overall win percentages, or by using a formulaic approach.

In a further embodiment of the present invention, multiple games can be played simultaneously. When a game is about to begin, a player can wager any multiple of his or her original wager and play the respective multiple of games simultaneously. For example, a player can wager of three times a normal wager, place his or her bet(s), and then play three games simultaneously. A player has the option of playing a standard single game, or breaking the game up into multiple games.

Figure 5:
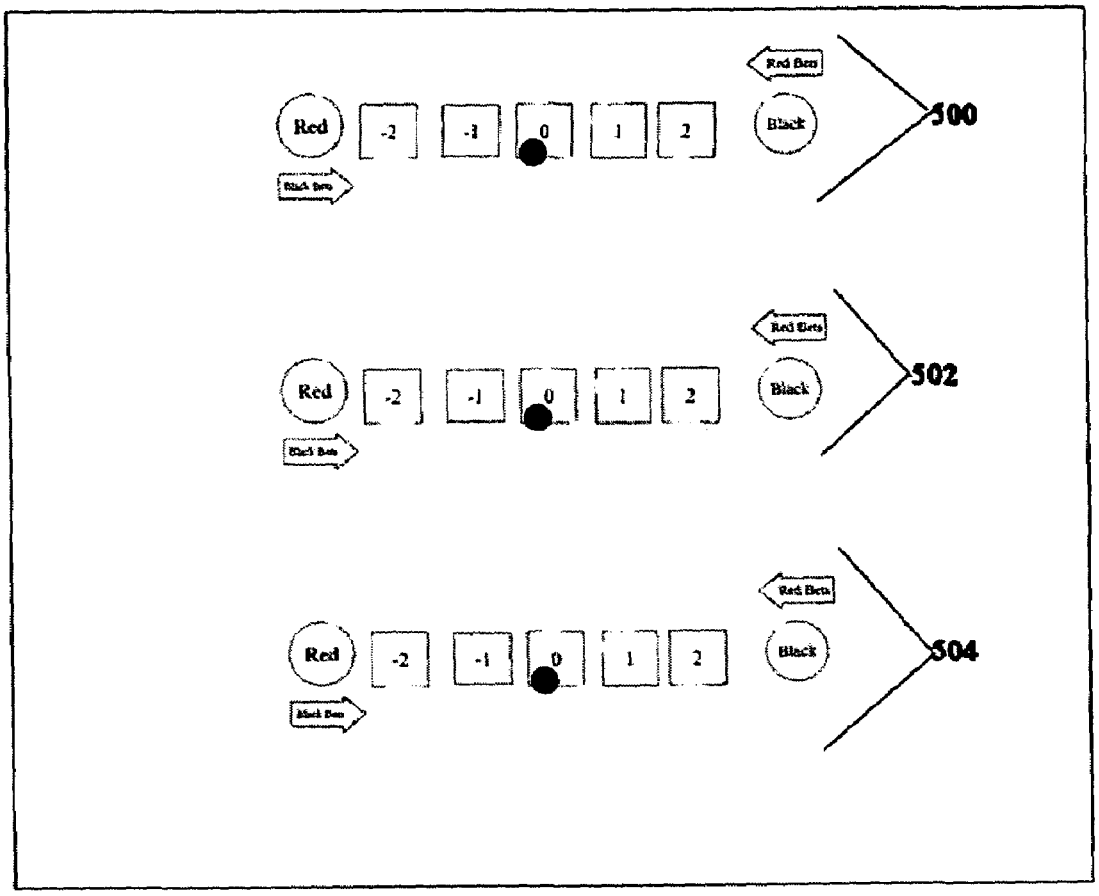
FIG. 5 is a screen shot illustrating a multi line version of the present invention, according to an embodiment of the present invention.

FIG. 5 is a screen shot illustrating a multi line version of the present invention, according to an embodiment of the present invention.

Top field 500, middle field 502, and bottom field 504, are all individual games as described above. However, each field/game operates independently of another and the player can play each as described above. Of course, any number of fields can be played simultaneously.

Figure 6:
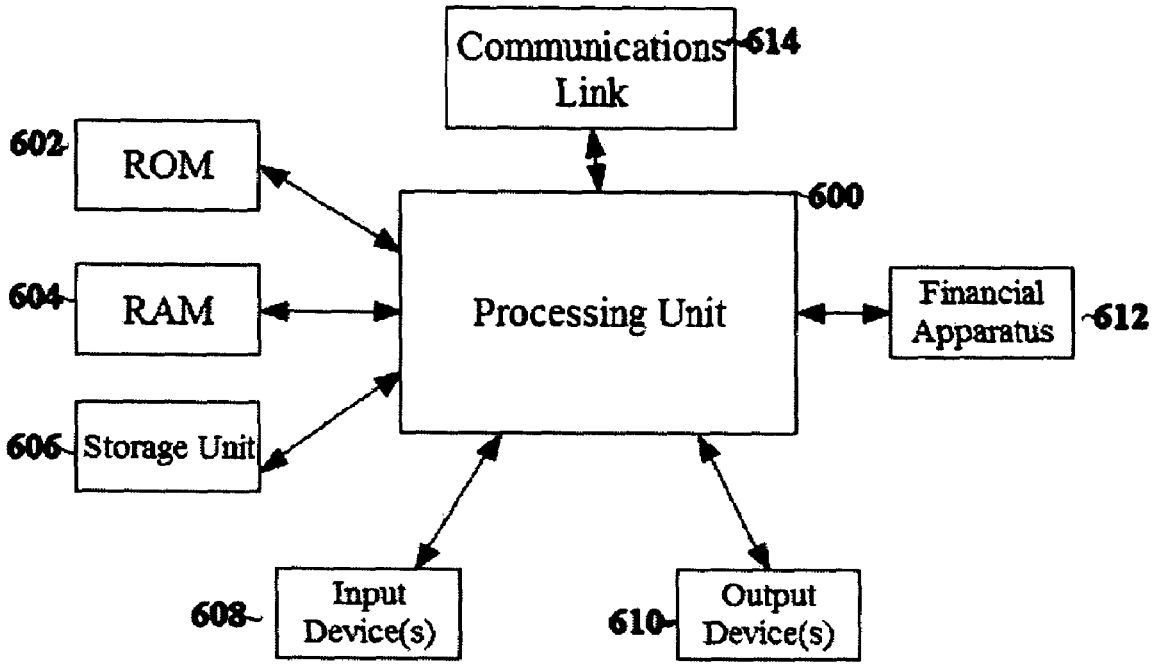
FIG. 6 is a block diagram illustrating one example of hardware that can be used to implement an electronic gaming device version of present invention, according to an embodiment of the present invention.

FIG. 6 is a block diagram illustrating one example of hardware that can be used to implement an EGD version of present invention, according to an embodiment of the present invention.

A processing unit 600 is connected to a ROM 602, RAM 604, and a storage unit 606 such as a hard drive, CD-ROM, etc. The processing unit 600 is also connected to an input device(s) 608 such as a touch sensitive display, buttons, keyboard, mouse, etc. The processing unit 600 is also connected to an output device(s) 610 such as a video display, audio output devices, etc. The processing unit 600 is also connected to a financial apparatus 612, which can accept payments and handle all facets of financial transactions. The processing unit 600 is also connected to a communications link 614 which connects the gaming device to a casino network or other communications network.

It is also noted that any and/or all of the above embodiments, configurations, variations of the present invention described above can mixed and matched and used in any combination with one another. Any claim herein can be combined with any others (unless the results are nonsensical).

Moreover, any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of playing a casino game, comprising:

displaying a linear playing field comprising a plurality of discrete positions including a center and a first end and a second end and a piece in an initial position;

receiving a first wager that the piece will reach a first desired end comprising either the first end or the second end;

moving the piece in either direction on the field to a further position which is one of the plurality of discrete positions, in accordance with a random number generator;

receiving a second wager when the piece is in the further position, that the piece will reach a second desired end, the second desired end being different from the first desired end; and continuing the moving of the piece until the piece reaches either the first end or the second end, and then accounting for the first wager and the second wager, wherein payouts on the second wager vary depending on the further position and the second desired end.

2. A method as recited in claim 1, wherein when the first wager is made when the piece is in the center, the wager pays even money with a house commission deducted.

3. A method as recited in claim 1, wherein, for the second wager, a particular discrete position has an associated particular first end payout for the piece to reach the first end and an associated particular second end payout for the piece to reach the second end, and a different discrete position has an associated different first end payout for the piece to reach the first end and an associated different second end payout for the piece to reach the second end, the particular first end payout and the different first end payout being different from each other.

4. A method of playing a casino game, comprising:

displaying a linear playing field with a center and a first end and a second end;

receiving a wager that a piece will reach a desired end comprising either the first end or the second end;

moving the piece in either direction on the field in accordance with a random number generator;

when the piece reaches either the first end or the second end, accounting for the wager; and offering a side wager based on a number of times the random number generator will be invoked before the piece reaches either end.

5. A method of playing a casino game, comprising:

displaying a linear playing field with a center and a first end and a second end;

receiving a wager that a piece will reach a desired end comprising either the first end or the second end;

moving the piece in either direction on the field in accordance with a random number generator; and when the piece reaches either the first end or the second end, accounting for the wager;

offering a side wager on whether a number of times the random number generator will be invoked will exceed a predetermined number.

6. A method of playing a casino game, comprising:

displaying a linear playing field with a center and a first end and a second end;

receiving a wager that a piece will reach a desired end comprising either the first end or the second end;

moving the piece in either direction on the field in accordance with a random number generator; and when the piece reaches either the first end or the second end, accounting for the wager;

offering a side wager on whether a number of times the random number generator will be invoked will fall below a predetermined number.

7. A method as recited in claim 1, wherein the random number generator comprises a die.

8. A method as recited in claim 1, further comprising moving the first wager and the second wager onto an area of a table whereby the position of the wager indicates a desired end and a location of the piece when the wager was placed.

9. A method as recited in claim 1, further comprising offering a side bet on an outcome of a next output of the random number generator.

10. A method as recited in claim 1, further comprising using respective lines for each player in order to identify which player has placed the first wager and the second wager.

11. A method as recited in claim 10, further comprising using alignments on the respective lines in order to identify which position the puck was on when each wager was placed.

12. A method as recited in claim 1, further comprising using a mini field for each player to easily identify each player's particular wager.

13. A method as recited in claim 1, further comprising allowing the player to relocate the piece upon approval of a dealer.

14. A method as recited in claim 1, further comprising initiating a jackpot or bonus round when the random number generator has been invoked a predetermined number of times without a resolution of the game.

15. A method as recited in claim 1, further comprising offering an option which automatically advances a current game to resolution.

16. A method as recited in claim 1, further comprising allowing the player to position the piece in any position on the field.

17. A method as recited in claim 1, further comprising allowing the player to position the piece in any position on the field, wherein the player can position the piece only when there are no active bets on the field.

18. A method as recited in claim 1, wherein payouts on the second wager are determined by a matrix which has two payouts associated with discrete positions on the playing field, one payout for the piece to reach the first end from the associated discrete position and one payout for the piece to reach the second end from the associated discrete position, the two payouts are different for different discrete positions.

19. A method as recited in claim 1, further comprising determining if a betting opportunity exists which would guarantee the player a net win, and if so, automatically notifying the player of the betting opportunity.

20. A method as recited in claim 1, further comprising determining if a betting opportunity exists which would result in the player having a chance greater than a predetermined threshold of a net win; and if so, automatically notifying the player of the betting opportunity.

* * * * *